US009941085B2

(12) United States Patent
Cox et al.

(10) Patent No.: US 9,941,085 B2
(45) Date of Patent: Apr. 10, 2018

(54) ELECTRICAL SWITCHING APPARATUS, AND MOVABLE ARM ASSEMBLY AND MOVABLE ARM THEREFOR

(71) Applicant: EATON CORPORATION, Cleveland, OH (US)

(72) Inventors: Jeffrey Michael Cox, Pittsburgh, PA (US); Jeffrey Wayne Lockhart, Pittsburgh, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 82 days.

(21) Appl. No.: 14/987,814

(22) Filed: Jan. 5, 2016

(65) Prior Publication Data

US 2017/0194122 A1 Jul. 6, 2017

(51) Int. Cl.
*H01H 71/24* (2006.01)
*H01H 71/52* (2006.01)

(52) U.S. Cl.
CPC ..... *H01H 71/24* (2013.01); *H01H 71/52* (2013.01); *H01H 2205/002* (2013.01)

(58) Field of Classification Search
CPC .... H01H 71/24; H01H 2205/002; H01H 1/02; H01H 3/02; H01H 1/22
See application file for complete search history.

(56) References Cited

U.S. PATENT DOCUMENTS 6,084,756 A * 7/2000 Doring ..... G01R 31/3277 324/527
7,148,774 B1 * 12/2006 Shea ..... H01H 1/22 218/22
7,217,895 B1 5/2007 Shea et al.
7,812,276 B2 10/2010 Maloney et al.
8,039,770 B2 10/2011 Schaltenbrand et al.
9,147,531 B2 9/2015 Maloney et al.

* cited by examiner

*Primary Examiner* — Bernard Rojas
(74) *Attorney, Agent, or Firm* — Eckert Seamans

(57) ABSTRACT

A movable arm is for a movable arm assembly of an electrical switching apparatus. The movable arm assembly includes a first separable contact. The electrical switching apparatus has a housing, an operating handle coupled to the housing, and a second separable contact located internal the housing and being structured to engage the first separable contact. The movable arm includes a first arm member structured to be coupled to the first separable contact; and a second arm member coupled to the first arm member, the second arm member being structured to be coupled to the operating handle. The first arm member is made from a first copper material and the second arm member is made from a second, different copper material.

21 Claims, 4 Drawing Sheets

ELECTRICAL SWITCHING APPARATUS, AND MOVABLE ARM ASSEMBLY AND MOVABLE ARM THEREFOR

BACKGROUND

Field

The disclosed concept relates to electrical switching apparatus, such as, for example, circuit breakers. The disclosed concept also relates to movable arm assemblies and movable arms for electrical switching apparatus.

Background Information

Electrical switching apparatus include, for example, circuit switching devices; circuit interrupters, such as circuit breakers; network protectors; contactors; motor starters; motor controllers; and other load controllers. Circuit breakers are used to protect electrical circuitry from damage due to an overcurrent condition, such as an overload condition or a relatively high level short circuit or fault condition. Small power switches, which are commonly referred to as miniature circuit breakers, are used, for example, in residential and light commercial electrical distribution systems. Miniature circuit breakers typically include a set of separable electrical contacts. The separable electrical contacts are in physical and electrical contact with one another when it is desired that the circuit breaker energize a power circuit. When it is desired to interrupt the power circuit, the separable electrical contacts are separated. This is generally accomplished by way of a movable arm. More specifically, one of the separable contacts (e.g., a movable contact) is located at an end of the movable arm, and when the movable arm moves away from the other separable contact, the power circuit is interrupted. In many known miniature circuit breakers, the other end of the movable arm (e.g., the end opposite the movable contact) interfaces with an operating handle of the circuit breaker.

In order for the circuit breaker to be properly certified, such as, for example and without limitation, to be properly certified by Underwriters Laboratories Inc., headquartered in Northbrook, Ill., the circuit breaker must be able to interrupt predetermined currents without failing. Testing in connection with ensuring certification criteria are satisfied has shown that the interface between the movable arm and the operating handle becomes undesirably hot. As a result, the operating handle, which is commonly made of thermoset materials, will be exposed to performance degradation in the form of an inability to act as an effective insulator.

There is thus room for improvement in electrical switching apparatus, and in movable arm assemblies and movable arms therefor.

SUMMARY

These needs and others are met by embodiments of the disclosed concept, which are directed to an electrical switching apparatus, and movable arm assembly and movable arm therefor, in which the movable arm includes a first arm member made from a first copper material and a second arm member made from a second, different copper material.

In accordance with one aspect of the disclosed concept, a movable arm for a movable arm assembly of an electrical switching apparatus is provided. The movable arm assembly includes a first separable contact. The electrical switching apparatus has a housing, an operating handle coupled to the housing, and a second separable contact located internal the housing and being structured to engage the first separable contact. The movable arm comprises a first arm member structured to be coupled to the first separable contact; and a second arm member coupled to the first arm member, the second arm member being structured to be coupled to the operating handle. The first arm member is made from a first copper material and the second arm member is made from a second, different copper material.

In accordance with another aspect of the disclosed concept, a movable arm assembly for an electrical switching apparatus is provided. The electrical switching apparatus includes a housing, an operating handle coupled to the housing, and a first separable contact located internal the housing. The movable arm assembly comprises a second separable contact structured to engage the first separable contact; and a movable arm comprising a first arm member coupled to the second separable contact, and a second arm member coupled to the first arm member, the second arm member being structured to be coupled to the operating handle. The first arm member is made from a first copper material and the second arm member is made from a second, different copper material.

In accordance with another aspect of the disclosed concept, an electrical switching apparatus comprises a housing; an operating handle coupled to the housing; a first separable contact located internal the housing; and a movable arm assembly comprising a second separable contact structured to engage the first separable contact, and a movable arm comprising a first arm member coupled to the second separable contact, and a second arm member coupled to the first arm member, the second arm member being coupled to the operating handle. The first arm member is made from a first copper material and the second arm member is made from a second, different copper material.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

Figure 1:
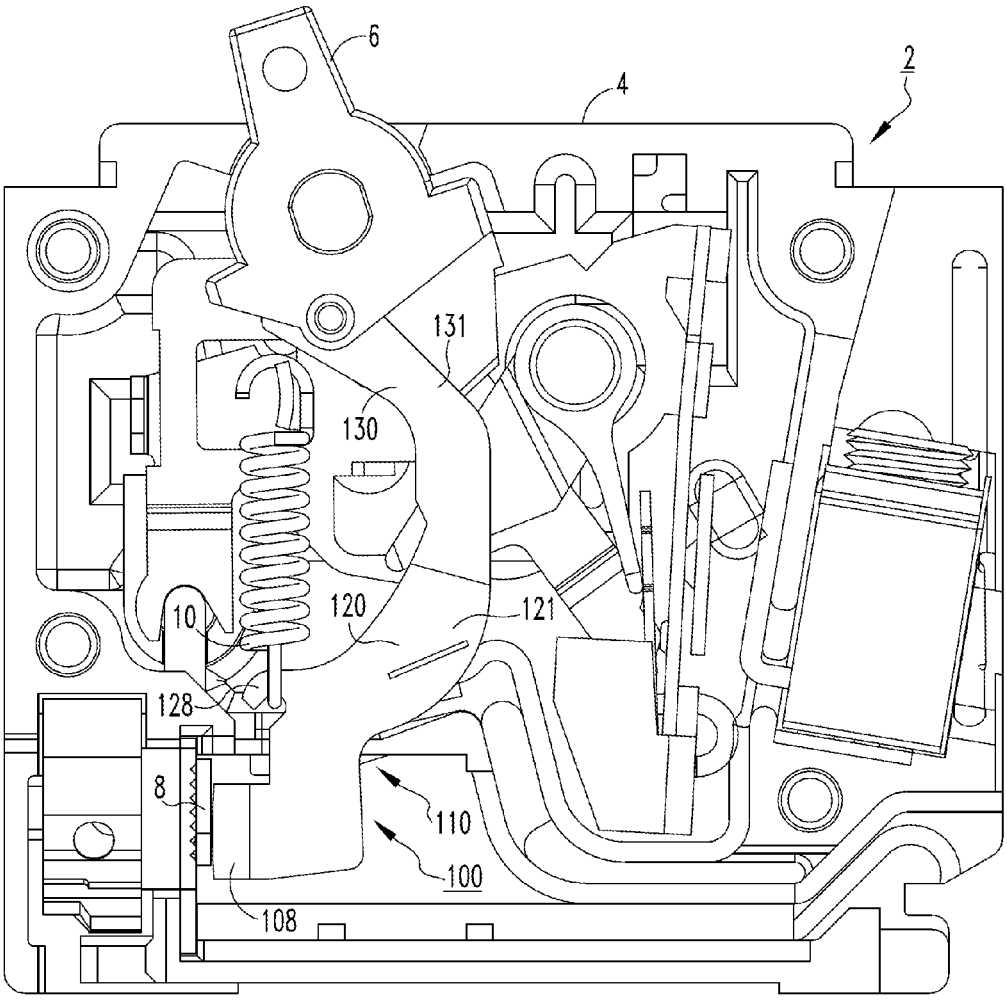
FIG. 1 is a front elevation view of a portion of an electrical switching apparatus, and movable arm assembly and movable arm therefor, in accordance with a non-limiting embodiment of the disclosed concept.

FIG. 1 shows a front elevation view of a portion of an electrical switching apparatus (e.g., without limitation, miniature circuit breaker 2) in accordance with a non-limiting embodiment of the disclosed concept. The example circuit breaker 2 includes a housing 4, an operating handle 6 coupled to the housing 4, a stationary separable contact 8 located internal the housing 4, and an operating spring 10. The circuit breaker 2 further includes a movable arm assembly 100 that has a movable separable contact 108 structured to move into and out of engagement with the stationary separable contact 8 in order to close and open the circuit breaker 2, respectively. As will be discussed in greater detail hereinbelow, the movable arm assembly 100 further includes a movable arm 110 that is advantageously structured to reliably conduct electricity while simultaneously transferring relatively minimal amounts of heat from the separable contacts 8,108 to the operating handle 6. In this manner, unlike prior art movable arms (not shown), which often do not prevent the respective operating handle from overheating and/or suffering from performance degradation during, for example, testing by Underwriters Laboratories Inc., the movable arm 110 advantageously allows the operating handle 6 to remain uncompromised during testing.

Figure 2:
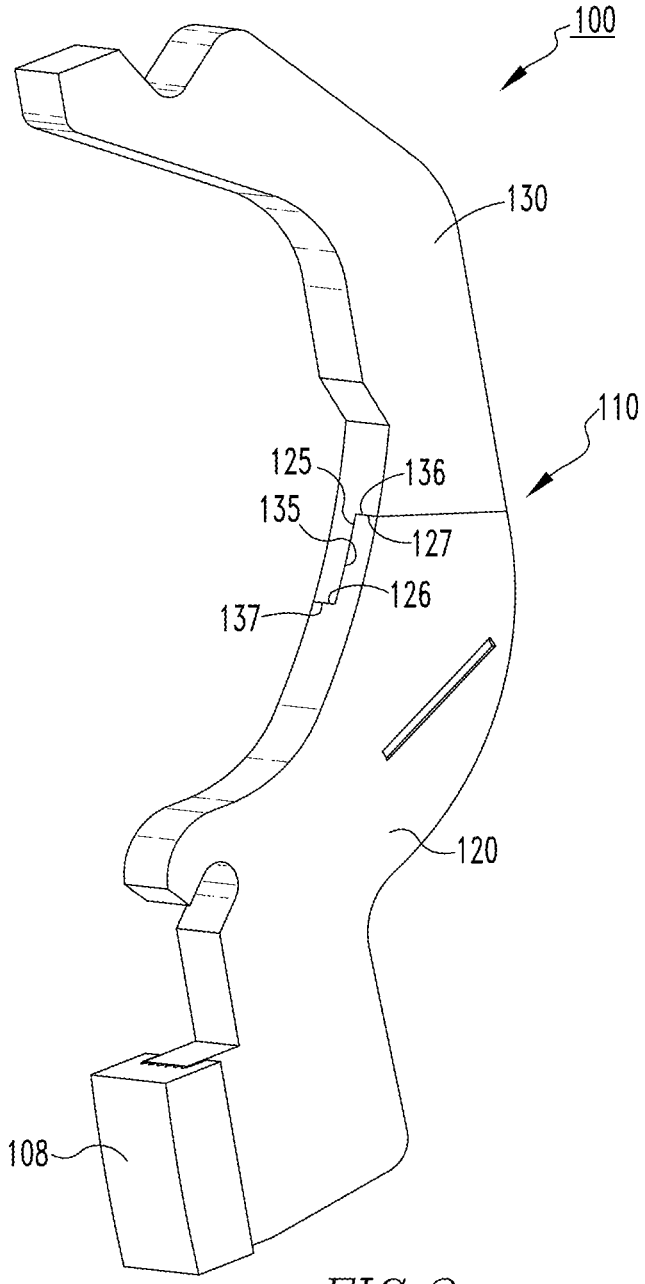
FIG. 2 is a front isometric view of the movable arm assembly of FIG. 1.
Figure 3:
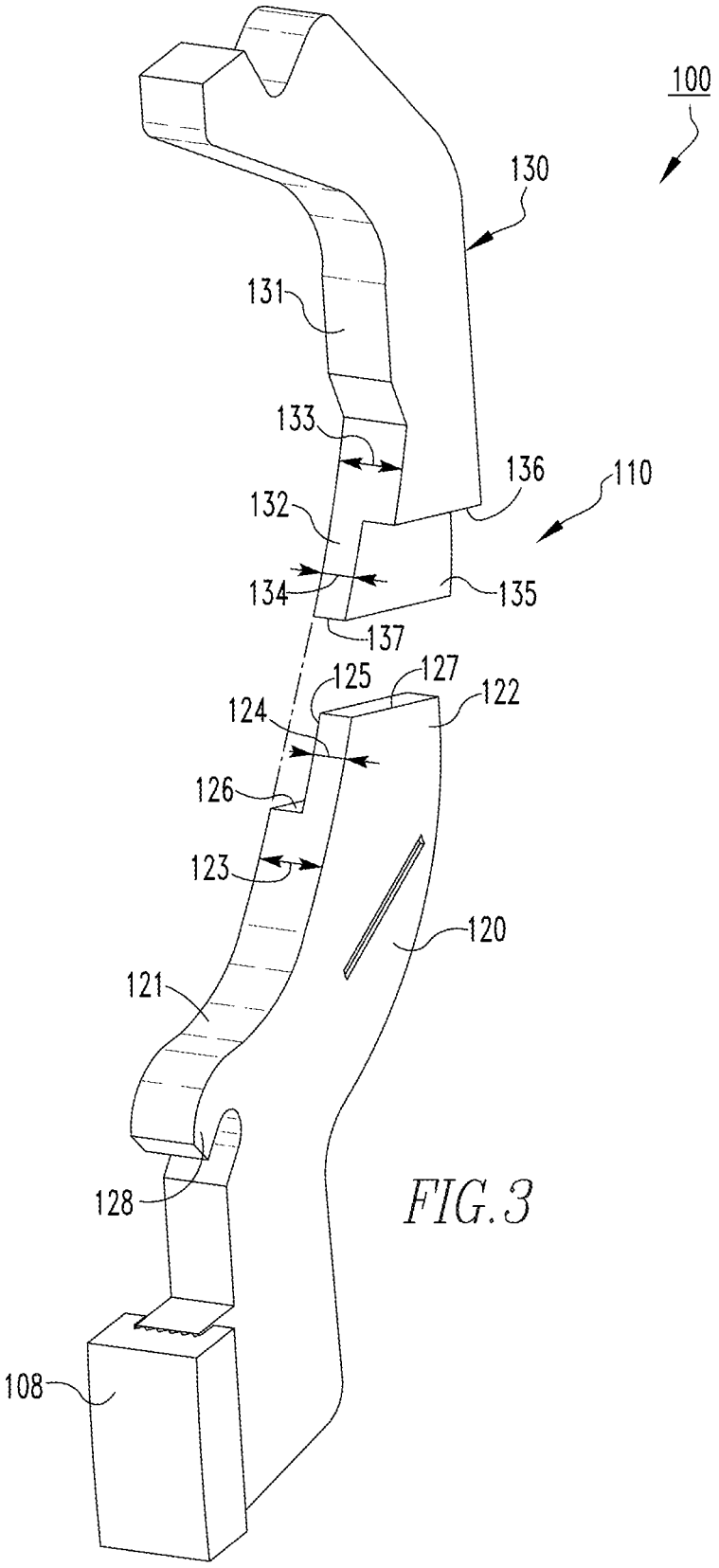
FIG. 3 is an exploded front isometric view of the movable arm assembly of FIG. 2.

Referring to FIGS. 2 and 3, in order to reduce the transfer of heat from the movable separable contact 108 to the operating handle 6 (FIG. 1), the movable arm 110 includes a first arm member 120 made from a first copper material and a second arm member 130 coupled to the first arm member 120 and being made from a second, different copper material. The first arm member 120 is coupled to the movable separable contact 108, and the second arm member 130 does not engage the movable separable contact 108. Additionally, the second arm member 130 is coupled to the operating handle 6 (FIG. 1) and the first arm member 120 does not engage the operating handle 6 (FIG. 1). The first copper material of the first arm member 120 is preferably a suitable silver bearing copper material having a thermal conductivity greater than 320 watts per meter kelvin and an electrical conductivity greater than an International Annealed Copper Standard (IACS) value of 80%. The second copper material of the second arm member 130 is preferably a suitable phosphor bronze copper material having a thermal conductivity less than 100 watts per meter kelvin and an electrical conductivity less than an IACS value of 35%. In this manner, the movable arm 110 utilizes the relatively high electrical conductivity of the first arm member 120 and the relatively low thermal conductivity of the second arm member 130 in order to reliably conduct electricity from the separable contacts 8,108, while simultaneously transferring relatively minimal amounts of heat to the operating handle 6 (FIG. 1).

Continuing to refer to FIG. 3, the arm members 120,130 each have a respective body portion 121,131 and a respective coupling portion 122,132 extending from and being thinner than the respective body portion 121,131. The body portions 121,131 and the coupling portions 122,132 each have a respective thickness 123,124,133,134, and it will be appreciated that the sum of thicknesses 124,134 is generally the same as each of the thicknesses 123,133. In this manner, the circuit breaker 2 is advantageously able to accommodate the movable arm 110 without requiring modification to any additional components.

Figure 4:
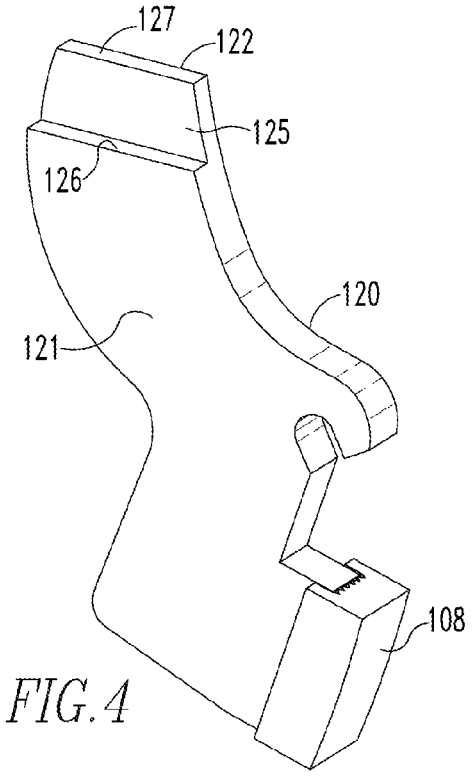
FIG. 4 is a rear isometric view of an arm member, shown coupled to a separable contact, for the movable arm assembly of FIG. 3.
Figure 5:
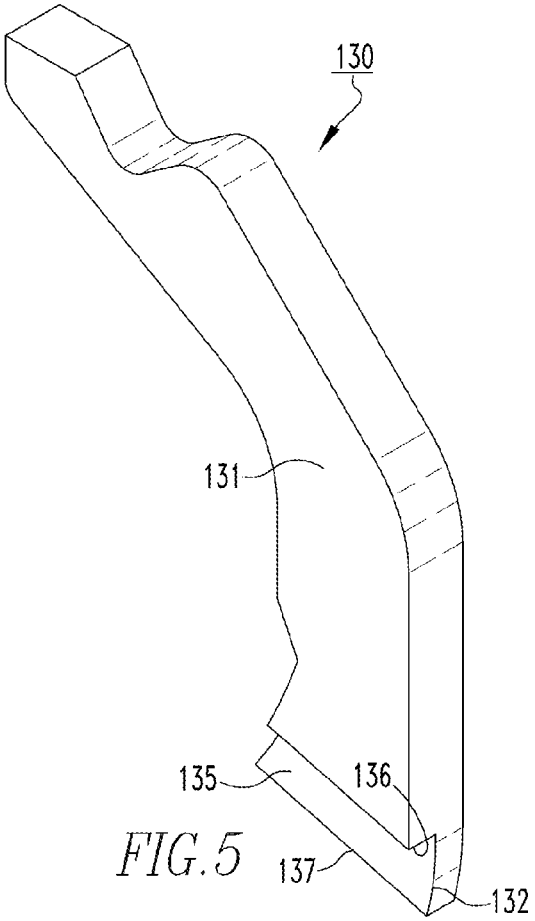
FIG. 5 is a front isometric view of another arm member for the movable arm assembly of FIG. 3.

The coupling portions 122,132 are structured to be coupled together by way of a brazed lap joint. More specifically, as shown in FIGS. 4 and 5, the coupling portions 122,132 each include respective first planar surfaces 125, 135, respective second planar surfaces 126,136, and respective third planar surfaces 127,137. The second planar surfaces 126,136 and the third planar surfaces 127,137 each extend from and are generally perpendicular to the respective first planar surfaces 125,135. It will be appreciated that when assembled, the first planar surfaces 125,135 are generally flush with one another, the second planar surface 126 is generally flush with the third planar surface 137, and the second planar surface 136 is generally flush with the third planar surface 127. Additionally, each of the respective first inner surfaces 125,135 faces in a direction that is perpendicular to a plane of the movable arm 110. In other words, in the example shown and described herein, the coupling portions 122,132 cooperate to form an overlapping joint. Among other benefits, such an overlapping structure provides an effective and strong junction of the arm members 120,130.

By having the second and third planar surfaces 126,127, 136,137 be perpendicular to the respective first planar surfaces 125,135, many forces exerted on the movable arm 110 in operation (e.g., without limitation, by the separable contacts 8,108) that are in a direction along a plane of the movable arm 110, will not cause the arm members 120,130 to move with respect to each other. Additionally, in order to securely couple the arm members 120,130 to each other, the coupling portions 122,132 (i.e., the planar surfaces 125,126, 127,135,136,137) are brazed together with a suitable brazing material. It will, however, be appreciated that a suitable alternative mechanism may be employed to couple the arm members 120,130, or similar suitable alternative arm members (not shown) together. For example and without limitation, the first arm member 120 may be chemically bonded (e.g., without limitation, by way of diffusion bonding) to the second arm member 130.

Furthermore, the material nature of the arm members 120,130 advantageously does not result in significant stresses at the brazed joint. More specifically, the first copper material of the first arm member 120 and the second copper material of the second arm member 130 each have substantially the same coefficient of thermal expansion, preferably being between 9.2 and 10.4 per degree Fahrenheit. In this manner, when the movable arm 110 is used cyclically at elevated temperatures during operation of the circuit breaker 2, the arm members 120,130 will advantageously not experience significantly high stresses due to any material differences.

Referring again to FIG. 1, the body portion 121 of the first arm member 120 includes a hook portion 128 engaging the operating spring 10 that allows the operating spring 10 to move the movable arm 110. As seen, the second arm member 130 is spaced from the hook portion 128, and each of the arm members 120,130 makes up about half of a total length of the movable arm 110. In this manner, the material advantages of the first arm member 120 and the second arm member 130 (i.e., electrical conductivity and thermal conductivity, respectively) are advantageously able to be realized by the movable arm 110. It will, however, be appreciated that a similar suitable alternative movable arm (not shown) could have different proportions such as, for example, a second arm member longer than a first arm member such that the hook portion would be located in the second arm member, without departing from the scope of the disclosed concept.

As mentioned hereinabove, the second arm member 130 has a thermal conductivity between 50 and 100 watts per meter kelvin. This is significantly less than the thermal conductivity of prior art movable arms (not shown), which is typically at least 300 watts per meter kelvin. As a result, the movable arm 110 advantageously transfers relatively minimal amounts of heat from the separable contacts 8,108 (FIG. 1) to the operating handle 6 (FIG. 1), thereby protecting the structural integrity of the operating handle 6 (FIG. 1) in operation and during, for example, testing by Underwriters Laboratories Inc. This corresponds to an increase in life and an improvement in performance capabilities of the circuit breaker 2 (FIG. 1). Additionally, as mentioned hereinabove, the first arm member 120 has a relatively high electrical conductivity (e.g., without limitation, greater than 80% IACS), advantageously allowing electricity to be reliably conducted from the separable contacts 8,108 (FIG. 1) into the movable arm 110.

Although the first copper material of the first arm member 120 is disclosed as being a suitable silver bearing copper material and the second copper material of the second arm member 130 is disclosed as being a suitable phosphor bronze copper material, it will be appreciated that similar suitable alternative copper materials may be employed in order to perform the desired functions of reliably conducting electricity while simultaneously transferring relatively minimal amounts of heat from the separable contacts 8,108 (FIG. 1) to the operating handle 6 (FIG. 1), without departing from the scope of the disclosed concept.

Accordingly, it will be appreciated that the disclosed concept provides for an improved (e.g., without limitation, longer lasting, better protected from overheating) electrical switching apparatus 2, and movable arm assembly 100 and movable arm 110 therefor, in which the movable arm 110 includes arm members 120,130 that are made of different copper materials in order to allow relatively minimal amounts of heat to be transferred through the movable arm 110, while simultaneously allowing the movable arm 110 to reliably conduct electricity.

While specific embodiments of the disclosed concept have been described in detail, it will be appreciated by those skilled in the art that various modifications and alternatives to those details could be developed in light of the overall teachings of the disclosure.

Accordingly, the particular arrangements disclosed are meant to be illustrative only and not limiting as to the scope of the disclosed concept which is to be given the full breadth of the claims appended and any and all equivalents thereof.

What is claimed is:

1. A movable arm for a movable arm assembly of an electrical switching apparatus, said movable arm assembly comprising a first separable contact, said electrical switching apparatus comprising a housing, an operating handle coupled to said housing, and a second separable contact disposed internal said housing and being structured to engage said first separable contact, said movable arm comprising:

a first arm member structured to be coupled to said first separable contact; and a second arm member coupled to said first arm member, said second arm member being structured to be coupled to said operating handle, wherein said first arm member is made from a first copper material and said second arm member is made from a second, different copper material;

wherein said first arm member has a first coefficient of thermal expansion; and wherein said second arm member has a second coefficient of thermal expansion substantially the same as the first coefficient of thermal expansion.

2. The movable arm of claim 1 wherein each of said first arm member and said second arm member comprises a body portion and a coupling portion extending from and being thinner than the body portion; and wherein the coupling portion of said first arm member is coupled to the coupling portion of said second arm member.

3. The movable arm of claim 2 wherein the coupling portion of said first arm member is brazed to the coupling portion of said second arm member.

4. The movable arm of claim 1 wherein said second arm member has a thermal conductivity less than 100 watts per meter kelvin.

5. The movable arm of claim 4 wherein said first arm member has a thermal conductivity greater than 320 watts per meter kelvin.

6. The movable arm of claim 1 wherein said second arm member has an electrical conductivity less than 35% International Annealed Copper Standard.

7. The movable arm of claim 6 wherein said first arm member has an electrical conductivity greater than 80% International Annealed Copper Standard.

8. The movable arm of claim 1 wherein the second copper material is a phosphor bronze copper material.

9. The movable arm of claim 8 wherein the first copper material is a silver bearing copper material.

10. The movable arm of claim 1 wherein said first arm member is chemically bonded to said second arm member.

11. The movable arm of claim 1 wherein said electrical switching apparatus further comprises an operating spring; wherein said first arm member comprises a hook portion structured to engage said operating spring; and wherein said second arm member is spaced from the hook portion.

12. A movable arm for a movable arm assembly of an electrical switching apparatus, said movable arm assembly comprising a first separable contact, said electrical switching apparatus comprising a housing, an operating handle coupled to said housing, and a second separable contact disposed internal said housing and being structured to engage said first separable contact, said movable arm comprising:

a first arm member structured to be coupled to said first separable contact and a second arm member coupled to said first arm member, said second arm member being structured to be coupled to said operating handle, wherein said first arm member is made from a first copper material and said second arm member is made from a second, different copper material;

wherein each of said first arm member and said second arm member comprises a body portion and a coupling portion extending from and being thinner than the body portion; and wherein the coupling portion of said first arm member is coupled to the coupling portion of said second arm member;

wherein the coupling portion of each of said first arm member and said second arm member comprises a first planar surface, a second planar surface extending from and being perpendicular to the first planar surface, and a third planar surface extending from and being perpendicular to the first planar surface; wherein the first planar surface of said first arm member is flush with the first planar surface of said second arm member; wherein the second planar surface of said first arm member is flush with the second planar surface of said second arm member; and wherein the third planar surface of said first arm member is flush with the third planar surface of said second arm member.

13. A movable arm for a movable arm assembly of an electrical switching apparatus, said movable arm assembly comprising a first separable contact, said electrical switching apparatus comprising a housing, an operating handle coupled to said housing, and a second separable contact disposed internal said housing and being structured to engage said first separable contact, said movable arm comprising:

a first arm member structured to be coupled to said first separable contact; and a second arm member coupled to said first arm member, said second arm member being structured to be coupled to said operating handle, wherein said first arm member is made from a first copper material and said second arm member is made from a second, different copper material;

wherein each of said first arm member and said second arm member comprises a body portion and a coupling portion extending from and being thinner than the body portion; and wherein the coupling portion of said first arm member is coupled to the coupling portion of said second arm member;

wherein the body portion of said first arm member has a first thickness; wherein the body portion of said second arm member has a second thickness; wherein the coupling portion of said first arm member has a third thickness; wherein the coupling portion of said second arm member has a fourth thickness; and wherein the sum of the third thickness and the fourth thickness is the same as each of the first thickness and the second thickness.

14. The moveable arm of claim 13 wherein said first arm member has a first coefficient of thermal expansion; and wherein said second arm member has a second coefficient of thermal expansion substantially the same as the first coefficient of thermal expansion.

15. A movable arm assembly for an electrical switching apparatus, said electrical switching apparatus comprising a housing, an operating handle coupled to said housing, and a first separable contact disposed internal said housing, said movable arm assembly comprising:

a second separable contact structured to engage said first separable contact; and a movable arm comprising:

a first arm member coupled to said second separable contact, and a second arm member coupled to said first arm member, said second arm member being structured to be coupled to said operating handle, wherein said first arm member is made from a first copper material and said second arm member is made from a second, different copper material;

wherein said first arm member has a first coefficient of thermal expansion; and wherein said second arm member has a second coefficient of thermal expansion substantially the same as the first coefficient of thermal expansion.

16. The movable arm assembly of claim 15 wherein said second arm member does not engage said second separable contact.

17. An electrical switching apparatus comprising:

a housing;

an operating handle coupled to said housing;

a first separable contact disposed internal said housing; and a movable arm assembly comprising:

a second separable contact structured to engage said first separable contact, and a movable arm comprising:

a first arm member coupled to said second separable contact, and a second arm member coupled to said first arm member, said second arm member being coupled to said operating handle, wherein said first arm member is made from a first copper material and said second arm member is made from a second, different copper material;

wherein said first arm member has a first coefficient of thermal expansion; and wherein said second arm member has a second coefficient of thermal expansion substantially the same as the first coefficient of thermal expansion.

18. The electrical switching apparatus of claim 17 wherein said first arm member does not engage said operating handle.

19. The electrical switching apparatus of claim 17 wherein said electrical switching apparatus further comprises an operating spring; wherein said first arm member comprises a hook portion engaging said operating spring; and wherein said second arm member is spaced from the hook portion.

20. The electrical switching apparatus of claim 17 wherein said second arm member has a thermal conductivity less than 100 watts per meter kelvin.

21. The electrical switching apparatus of claim 17 wherein said electrical switching apparatus is a miniature circuit breaker.

* * * * *